United States Patent [19]

Nakano

[11] Patent Number: 4,727,922

[45] Date of Patent: Mar. 1, 1988

[54] MOLD FOR HIGH-TEMPERATURE MOLTEN METAL AND METHOD OF PRODUCING HIGH-MELTING METAL ARTICLE

[76] Inventor: Akio Nakano, 14-1, Ichikawaminami 3-chome, Ichikawa-shi, Chiba-ken, Japan

[21] Appl. No.: 934,659

[22] Filed: Nov. 25, 1986

[30] Foreign Application Priority Data

Nov. 30, 1985 [JP] Japan ..... 60-270486

[51] Int. Cl.[4] ..... B22D 27/15; B22D 17/08

[52] U.S. Cl. ..... 164/61; 164/305; 164/113; 164/529; 164/369; 164/255; 164/410

[58] Field of Search ..... 164/410, 305, 113, 529, 164/369, 61, 65, 255

[56] References Cited

FOREIGN PATENT DOCUMENTS 60-83762 5/1985 Japan ..... 164/305

*Primary Examiner*—Kuang Y. Lin

*Attorney, Agent, or Firm*—Popper, Bobis & Jackson

[57] ABSTRACT

A mold and method for producing, or casting a high-melting metal article from a high-melting metal having a melting point of about 900° to 1600° C. includes a pair of male and female molds provided with a core part or liner part, one or both of the male and female molds formed of a ceramic, gases generated within a cavity in the solidification process of the molten metal are sucked out through the vent formed by incorporating a heat resistant, porous, gas-permeable material in which inserted detachably into the vent port of the gas vent passed through outward from the predetermined part of the cavity surfaces on the both molds of the core part and the liner part is drawn outward by a minute amount at a predetermined timing from the start of the pressurization of the interior of the mold cavity so that internal gases generated at a predetermined part of the interior of the mold cavity (at a thicker part where solidification occurs later than at other parts) are effectively discharged into the well in the auxiliary vent by the time the molten metal at the predetermined part is solidified, whereby even an article having a thicker part is molded without leaving gases in the thicker part.

10 Claims, 4 Drawing Figures

MOLD FOR HIGH-TEMPERATURE MOLTEN METAL AND METHOD OF PRODUCING HIGH-MELTING METAL ARTICLE

FIELD OF THE INVENTION

The present invention relates to a mold for a high-temperature molten metal and a method of producing a high-melting metal article by using the mold.

DESCRIPTION OF THE PRIOR ART

When a mold used for conventional die casting or molten-metal casting is used for molding a high-melting metal having a melting point of about 900° to 1600° C., the mold becomes unable to be used after from 5000 to 10000 shots, because of its poor heat resistance.

In connection with the large amount of gas generated at the time of solidification of a high-melting metal, a conventional mold having a vent constituted of a hole or groove has the problem that after the molten metal flows into the vent and the surface of the molten metal is covered with a solidified metal film, effective venting cannot be performed, resulting in formation of shrinkage cavity or gas porosity.

To solve the above-mentioned problem, a mold for a high-temperature molten metal as shown in FIG. 3 has been developed.

In this mold A', one or both of a pair of male and female molds $b_1$, $b_2$ provided with a liner part 22 and core parts 25, 25', respectively, are formed of a ceramic, both molds are provided with heating and cooling mechanisms, and a heat-resistant, porous, gas-permeable material is incorporated into the liner part 22 and the core parts 25, 25' to form vents 23, 27. In molding, the male and female molds $b_1$, $b_2$ are mated and clamped to each other (FIG. 4) and, simultaneously, evacuation by a vacuum mechanism C through the vents 23, 27 is started to remove the gases generated in the mold cavity during solidification as well as engulfed air.

The mold A', with one or both of the male mold $b_1$ and the female mold $b_2$ formed of a ceramic, has an extremely high heat resistance. In addition, since the vents are formed of the heat-resistant, porous, gas-permeable material, the molten metal making contact with the gas-permeable material will not leak to the exterior beyond the material, so that gas or the like generated during solidification of the metal can be effectively eliminated during the molding process, without formation of solidified metal films from leaked molten metal, which would be observed with conventional molds. Accordingly, a finished article with an extremely low extent of gas porosity can be produced by the mold.

However, even where the above-mentioned mold was used, gas porosity would in some cases be formed, depending on the shape of the article molded.

This problem is associated with the cases where the article has a thicker part. In such cases, the molten metal flowing into the thicker part is solidified more slowly than at thinner parts, so that internal gases are generated in the molten metal at the thicker part even after the other, thinner parts are solidified to inhibit the suction venting through the vents.

OBJECT AND SUMMARY OF THE INVENTION

An object of the present invention is to securely remove the gases generated from the above-mentioned thicker part of the finished article.

Another object of the invention is to provide a mold having the heat resistance and durability necessary for molding a high-melting metal having a melting point of about 900° to 1600° C.

Further objects of the invention will become apparent from the following detailed description and the drawings.

These objects are attained by the mold for a high-temperature molten metal and the method of producing a high-melting metal article by using the mold, which are provided by the present invention.

The mold for a high-temperature molten metal according to the first-named invention of the present invention comprises a pair of male and female molds provided with a core part or liner part, one or both of the male and female molds formed of a ceramic, a vent provided by incorporating a heat-resistant, porous, gas-permeable material into the core part or liner part, an auxiliary vent leading from a predetermined part of mold cavity surfaces of the male and female molds to the exterior of the mold, a well provided in the auxiliary vent in the vicinity of the mold cavity surface, and a vent plug provided at the outlet of the auxiliary vent so as to be capable of being freely inserted and drawn out, the vent plug formed of a heat-resistant material.

With this arrangement, after mold clamping, the gases generated in the mold cavity are removed through the vent constituted of the porous, gas-permeable material, whereas the internal gases generated in a thicker part where solidification takes place slowly are discharged into the well in the auxiliary vent by drawing the vent plug outwards.

The method of producing a high melting metal article according to the second-named invention comprises the steps of pouring a predetermined amount of a molten metal into a mold cavity of a pair of male and female molds, pressurizing the interior of the mold cavity, removing gases or the like generated in the solidification process of the molten metal in the mold cavity by sucking out the gases or the like through a vent provided by incorporating a heat-resistant, porous, gas-permeable material into a part of the molds, and drawing outward, at a predetermined timing from the start of the pressurization and by a minute amount, a vent plug provided in the auxiliary vent so as to be capable of being freely inserted and drawn out, thereby discharging internal gases generated at a predetermined part of the interior of the mold cavity to the exterior of the mold cavity.

According to the above-mentioned method, when the interior of the mold cavity is pressurized after pouring the molten metal into the mold cavity, the gases generated from the molten metal in the solidification process in the mold cavity as well as engulfed gases are removed by suction through the vent.

In addition, when the vent plug is drawn outward by a minute amount at a predetermined timing from the start of the pressurization in the mold cavity, the gases generaged from the molten metal having flowed into a predetermined part of the interior of the mold cavity (the part where solidification is retarded) are pushed out into a well in the auxiliary vent by the pressure inside the mold cavity, before solidification is completed.

DETAILED DESCRIPTION

Figure 1:
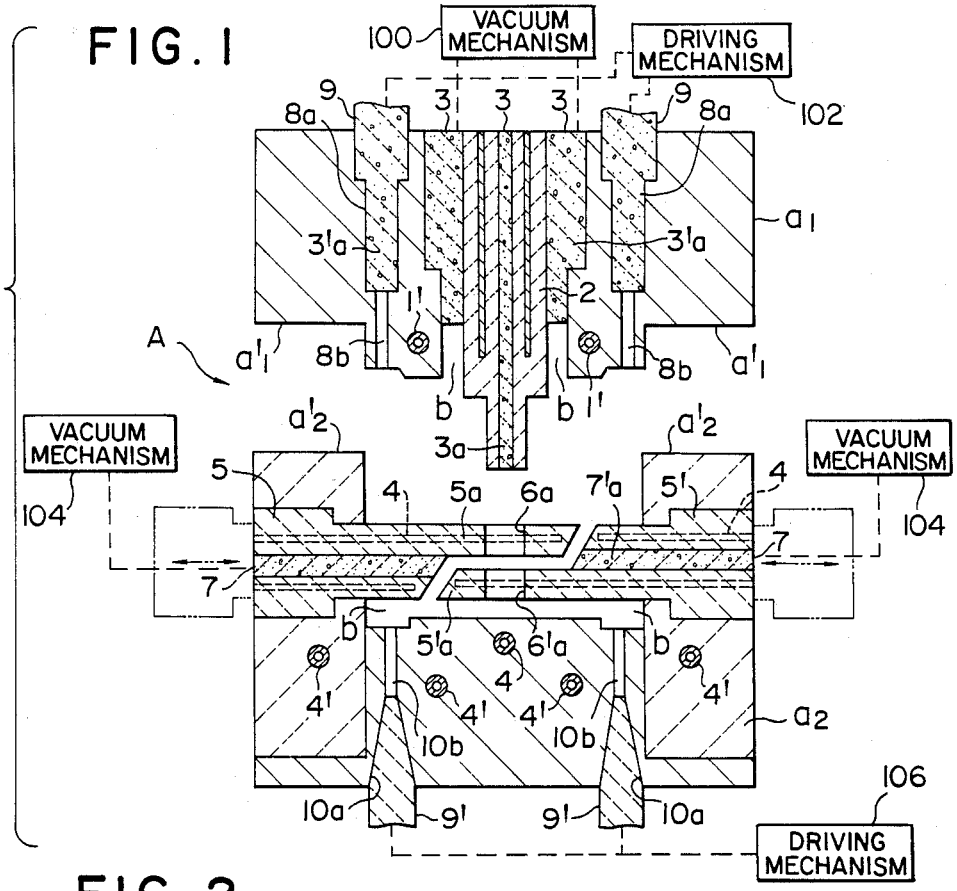
FIG. 1 is a vertical cross-sectional front view of a mold in the state before mold clamping.

One embodiment of the present invention will now be described below while referring to the drawings.

Figure 2:
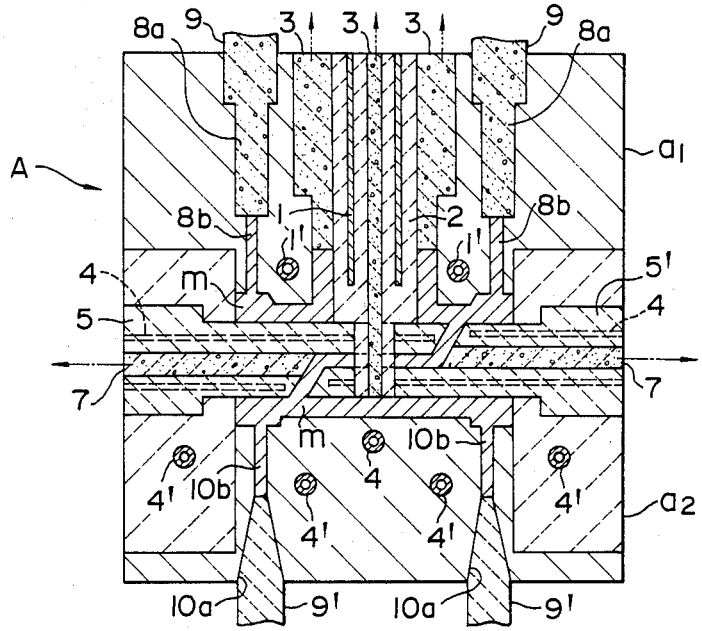
FIG. 2 is a vertical cross-sectional front view of the mold which has been clamped and been filled with a molten metal.
Figure 3:
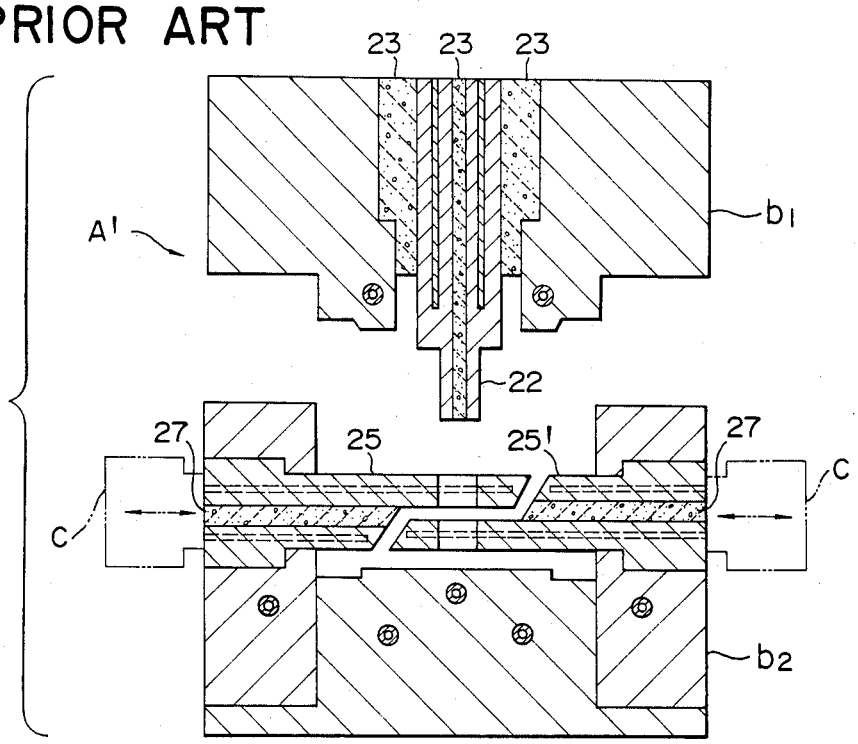
FIG. 3 PRIOR ART
FIGS. 3 and 4 are vertical cross-sectional front views of a conventional mold.
Figure 4:
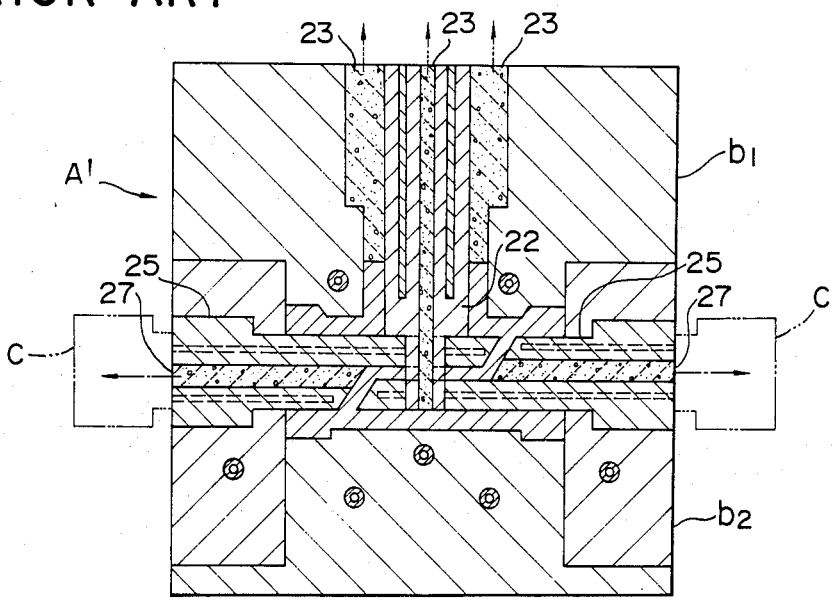
FIG. 4 PRIOR ART

In FIGS. 1 and 2, a mold A consists of a set of a male mold $a_1$ and a female mold $a_2$, which have joint surfaces $a'_1$ and $a'_2$.

The male mold $a_1$ is formed of a heat-resistant metal (including a sintered metal) such as high chromium molybdenum copper. A heating mechanism 1 and a cooling mechanism 1' are appropriately provided in the mold $a_1$ and a liner 2 which is vertically slidable is provided at a central part. Mold $a_1$ may be formed of a ceramic.

The liner 2 is formed of a heat-resistant metal or a ceramic, in which a porous ceramic 3*a* is inserted along the center axis, while a porous ceramic 3'*a* is integrally fitted over the outer periphery of the liner 2, and the outer surface of the outer peripheral ceramic 3'*a* is brought into frictional contact with the male mold $a_1$.

The porous ceramics 3*a*, 3'*a* constitute vents 3 of the male mold $a_1$, and the upper ends of the vents 3 are connected with a vacuum mechanism 100 so as to perform forced evacuation.

The male mold $a_1$ is provided with auxiliary vents 8*a*, 8*a* leading from a predetermined part of the surface of the mold cavity b to the exterior of the mold, and wells 8*b*, 8*b* are provided in the auxiliary vents 8*a*, 8*a* on the side of the cavity b. At the outlets of the auxiliary vents 8*a*, 8*a* are provided vent plugs 9, 9 formed from a heat-resistant, porous, gas-permeable material, e.g., a porous ceramic, so that the plugs can be freely inserted and drawn out while maintaining gas-tightness, and the plugs are retracted a minute amount from their fitted position by a driving mechanism 102 at a predetermined timing from the start of the pressurization in the mold cavity b, more precisely, at a timing such that a solidified metal film with such a thickness as to permit passage therethrough of internally generated gases under the pressure inside the mold cavity b is formed on the surface of the molten metal at a thicker part of the desired article at which the molten metal is solidified later than at other parts (thinner parts).

The predetermined part of the surface of the mold cavity at which to provide the auxiliary vents (8*a*), (8*a*) means the part at which the molten metal is solidified later than at other parts and gas porosity is liable to be formed, more particularly, a thicker part of the desired article or the like part.

The vent plugs 9, 9, which are formed of a porous, gas-permeable material, have the same venting function as that of the vents 3, 7. Namely, the gases in the mold cavity b are driven by the pressure inside the mold cavity b to pass through the plugs under the plugged condition, and forced suction may be applied thereto by a vacuum mechanism in the same manner as in the case of of the vents 3, 7.

The female mold $a_2$ is a ceramic mold, and is provided with a heating mechanism 4 and a cooling mechanism 4'. In addition, a pair of left and right sectional cores 5, 5' which are slidable sideways are fitted respectively from the left and right sides, and the cores 5, 5' are moved toward and away from the mold cavity b.

The sectional cores 5, 5' have tip parts 5*a*, 5'*a* opposed to each other with a predetermined gap therebetween in the vertical direction. The tip parts 5*a*, 5'*a* are provided with through-holes 6*a*, 6'*a* on the same axis, and a lower end part of the liner 2 is fitted into the holes 6*a*, 6'*a*.

The sectional cores 5, 5' are formed of a heat-resistant metal or a ceramic, and porous ceramics 7*a*, 7'*a* are inserted therein in the direction from side end faces toward the molding part. The ceramics 7*a*, 7'*a* constitute the vents 7 of the female mold $a_2$, and the outer ends of the vents 7 are connected with a vacuum mechanism 104 to perform forced evacuation.

The female mold $a_2$ also is provided with auxiliary vents 10*a*, 10*a* at appropriate parts thereof, and the vents 10*a*, 10*a* are provided with wells 10*b*, 10*b* on the mold cavity side thereof. In the outlets of the vents 10*a*, 10*a* are fitted vent plugs 9', 9' so that the plugs can be freely inserted and drawn out while maintaining gas-tightness, and the plugs 9', 9' also are retracted a minute amount from the fitted position by a driving mechanism 106 at the same timing as that for the vent plugs 9, 9.

The vent plugs 9', 9' are formed from a ceramic in a substantially conical shape, which is different from the shape of the vent plugs 9, 9, but the two kinds of vent plugs have the same function of instantaneously relieving the pressures in the auxiliary vents 8*a* and 10*a*, respectively, at a predetermined timing. Although the two types of vent plugs 9, 9' are provided in the vents 8*a*, 10*a* in combination in the mold A, either one type of vent plugs 9, 9' may be used in a standardized manner.

Now, the composition and structure of the ceramic for forming the male mold $a_1$ and/or female mold $a_2$, the liner 2, the cores 5, 5' and the vent plugs 9', 9' will be briefly described as follows.

The ceramic is a hot-pressed $\alpha$-sialon ceramic or normal pressure sintered $\alpha$-sialon ceramic which is a solid solution having the $\alpha$-$Si_3N_4$ structure and comprising a dense composite (dissolved) structure phase obtained by effecting interstitial dissolution of 60% by volume of granular crystals of $\alpha$-sialon represented by the formula $M \times (Si, Al)_{12}(O, N)_{16}$, wherein M is Mg, Ca, Y or the like ($\alpha$-phase) in 40% by weight of columnar crystals of $\beta$-$Si_3N_4$ ($\beta$-phase) by firing. The ceramic, in a compositional region which can be called "partially stabilized" $\alpha$-sialon region in which 60% by volume of the granular crystals of $\alpha$-sialon coexists with 40% by volume of the columnar crystals of $\beta$-$Si_3N_4$, has excellent mechanical properties such as strength, hardness and toughness value at rupture as well as resistance to thermal shocks and chemicals.

As described above, according to the present invention the gases generated in the mold cavity and air engulfed into the mold when pouring the molten metal can be removed through the vents, and, by drawing the vent plugs outward at a predetermined timing from the start of the pressurization in the mold cavity, the internal gases generated from, for example, the thicker part of the desired article at which solidification takes place slowly can also be discharged into the wells in the auxiliary vents. Accordingly, even an article having a thicker part can be molded without leaving gas porosity in the thicker part.

In addition, since one or both of the male and female molds are formed of a ceramic, the mold of the present invention has the heat resistance required for molding a high-melting metal having a melting point of about 900° to 1600° C., and can be used satisfactorily for a long period of time.

Now, a method of producing a die-cast article of a high-melting metal by using the above-mentioned mold A will be described below referring to the drawings.

Starting from the condition shown in FIG. 1 in which the sectional cores 5, 5' of the female mold $a_2$ are moved forward into combination with each other, the male mold $a_1$ is lowered to mate and clamp the molds $a_1$, $a_2$ to each other, then a melt of a high-melting metal having a melting point of 900° to 1600° C. is poured into the mold cavity b, and thereafter the interior of the mold cavity b is pressurized.

Then, the molding step is started, which continues until the mold is opened. In the beginning stage of the molding step, the heating mechanisms 1, 4 are operated to heat the interior of the molding part to an appropriate temperature, and thereafter the cooling mechanisms 1', 4' are operated to contrive an appropriate lowering of temperature.

In the molding step, the molten metal is pressurized by lowering the liner 2 while applying a forced suction to the interior of the mold cavity b through the porous ceramics *7a, 7'a* provided in the female mold $a_2$. Simultaneously with or shortly before the pressurization, application of a suction through the porous ceramics *3a, 3'a* provided at the liner 2 is started, and the gases generated in the mold cavity b and engulfed air are discharged to the exterior of the cavity b by the forced suction applied through the porous ceramics *3a, 3'a* and *7a, 7'a.*

On the other hand, the vent plugs 9, 9' are drawn outward by a minute amount at an appropriate timing from the start of the pressurization in the mold cavity b, more precisely, at a timing such that a solidified metal film with such a thickness as to permit passage therethrough of the internally generated gases under the pressure inside the mold cavity b is formed on the surface of the molten metal at a thicker part of the desired article at which the molten metal is solidified later than at other parts. By this, the pressures inside the auxiliary vents *8a, 10a* are released, and the internal gases generated in the mold cavity b at the thicker part of the desired article at which the solidification takes place slowly are purged into the wells *8b, 10b* in the auxiliary vents *8a, 10a* by the pressure inside the mold cavity b.

As mentioned above, the vent plugs 9, 9' are drawn outward by a minute amount. In the case of the vent plug 9, the minute amount is such that the pressure inside the mold cavity b is brought to an appropriate negative pressure, whereas in the case of the vent plug 9', the minute amount is such that the pressure inside the vent *10a* is a very little leaked to cause the molten metal in the vent *10a* to flow in to the periphery of the vent plug 9' in a small quantity.

As mentioned above, the molten metal in the mold cavity b is solidified under cooling by operating the cooling mechanisms 1', 4', after venting. After a predetermined lapse of time, the male mold $a_1$ is moved upward to open the mold, and the molded article is taken out of the female mold $a_2$.

The positions of the auxiliary vents *8a, 10a* and the number of vents *8a, 10a* that are provided, are determined by the conditions, such as temperature distribution inside the mold cavity and solidification rate at each part of the desired articles. Also, the setting conditions in which the heating mechanisms 1, 4 and the cooling mechanisms 1', 4' are provided for the male and female molds $a_1$, $a_2$ are appropriately changed according to the melting point of the metal to be melted, composition of the metal, mold shape of the mold, etc.

Although the case of molding a high-melting metal has been described in the above embodiment, the mold and the method according to the present invention may be used with a conventional process such as low-pressure casting and die casting.

As described above, according to the present invention, after pouring a molten metal into a mold cavity of a mold the interior of the cavity is pressurized to raise the pressure inside the cavity, and a suction is applied through vents constituted of a heat-resistant, porous, gas-permeable material, whereby the gases generated in the mold cavity during solidification of the molten metal and air engulfed at the time of pouring the molten metal into the cavity can be rapidly removed substantially completely through the vents.

In addition, by drawing the vent plugs outward by a minute amount at a predetermined timing from the start of the pressurization in the mold cavity, the internal gases generated in the mold cavity at a predetermined part (the part at which solidification takes place later than at other parts) can be effectively discharged into the wells in the aurixiliary vents through utilization of the timing of the solidification at the predetermined part and the pressure inside the cavity.

Thus, the gases generated from any part in the mold cavity can be completely discharged to the exterior of the cavity, irrespective of the shape of the article to be molded.

What is claimed is:

1. A mold for a high-temperature molten metal, comprising:

a pair of male and female molds provided with a core part or liner part, one or both of said male and female molds formed of a ceramic, a main vent provided by incorporating a heat-resistant, porous, gas-permeable material into said core part or liner part, an auxiliary vent leading from a predetermined part of mold cavity surfaces of said male and female molds to the exterior of said mold, a well provided in said auxiliary vent in the vicinity of said mold cavity surfaces, a vent plug provided at the outlet of said auxiliary vent so as to be capable of being freely inserted and drawn out, said vent plug formed of a heat-resistant material, means for sucking out gases or the like, generated in a solidification process of a molten metal poured into said mold cavity, through said main vent so as to remove said gases from said mold cavity, and means for drawing out said vent plug at a predetermined timing from a starting time of pressurization of said mold and by a minute amount.

2. A mold according to claim 1, wherein said core part or liner part is formed of a ceramic.

3. A mold according to claim 1, wherein said gas-permeable material is a porous ceramic.

4. A mold according to claim 1, wherein said vent plug is formed of a porous ceramic.

5. A mold according to claim 1, wherein said vent plug is formed of a ceramic.

6. A mold according to claim 1, wherein said means for sucking out includes a vacuum mechanism connected to said main vent.

7. A mold according to claim 1, wherein said mold forms a desired finished article having a thicker part and said predetermined part is positioned in said mold cavity surfaces so as to face the thicker part of the desired finished article in the mold at which said molten metal is solidified later than at other parts and gas porosity is liable to be formed.

8. A mold for a high-temperature molten material, comprising a pair of male and female molds provided with a core part or liner part, one or both of said male and female molds form of a ceramic, a vent provided by incorporated a heat-resistant, porous, gas-permeable material into said core part or liner part, an auxiliary vent leading from a predetermined part of mold cavity surfaces of said male and female molds to the exterior of said mold, a well provided in said auxiliary vent in the vicinity of said mold cavity surfaces, and a vent plug provided at the outlet of said auxiliary vent so as to be capable of being freely inserted and drawn out, said vent plug formed of a heat-resistant material, wherein said ceramic is a hot-pressed $\alpha$-sialon ceramic or normal pressure sintered $\alpha$-sialon ceramic which is a solid solution having the $\alpha$-$Si_3N_4$ structure and comprising a dense composite structure phase in a compositional region which can be called "partially stabilized" $\alpha$-sialon region, namely, a region in which 60% by volume of granular crystals of $\alpha$-sialon represented by the formula $M \times (Si, Al)_{12}(O, N)_{16}$, wherein M is Mg, Ca, Y or the like, coexists with 40% by volume of columnar crystals of $\beta$-$Si_3N_4$.

9. A method of producing a high-melting metal article comprising the steps of pouring a molten metal into a mold cavity of a pair of male and female molds, pressurizing the interior of said mold cavity, removing gases or the like generated in the solidification process of said molten metal in said mold cavity by sucking out said gases or the like through a vent provided by incorporating a heat-resistant, porous, gas-permeable material into a part of said molds, and drawing outward, at a predetermined timing from the start of said pressurization and by a minute amount, a vent plug provided so as to be capable of being freely inserted and drawn out, thereby discharging internal gases generated at a predetermined part of the interior of said mold cavity to the exterior of said mold cavity.

10. A method according to claim 9, wherein said predetermined timing is such that a solidified metal film with such a thickness as to permit passage therethrough of said internally generated gases under the pressure inside said mold cavity is formed on the surface of said molten metal at a thicker part of the desired article at which said molten material is solidified later than at other parts.

* * * * *